United States Patent [19]

Coxhill

[11] 4,084,756

[45] Apr. 18, 1978

[54] GEAR AND PINION BACKLASH ADJUSTMENT FOR THE DRIVE OF A GYRATORY CRUSHER

[75] Inventor: Major Coxhill, Appleton, Wis.

[73] Assignee: Allis-Chalmers Corporation, Milwaukee, Wis.

[21] Appl. No.: 693,784

[22] Filed: Jun. 8, 1976

[51] Int. Cl.[2] ..... B02C 2/04

[52] U.S. Cl. ..... 241/213; 74/409; 241/215

[58] Field of Search ..... 241/207, 209, 213, 215; 74/409

[56] References Cited

U.S. PATENT DOCUMENTS

| | | | |
|---|---|---|---|
| 2,703,497 | 3/1955 | Townsend | 74/409 UX |
| 3,744,728 | 7/1973 | Treppish | 241/207 |
| 3,811,335 | 5/1974 | Hunsberger | 74/409 |
| 3,837,585 | 9/1974 | Decker et al. | 241/215 X |
| 3,888,134 | 6/1975 | Miranda | 74/409 X |

*Primary Examiner*—Roy Lake
*Assistant Examiner*—Howard N. Goldberg
*Attorney, Agent, or Firm*—Robert C. Jones

[57] ABSTRACT

Centerline of the pinion and gear is offset from the centerline of the bore in which the pinion bearing housing is contained. A change holds the bearing housing in operating position and is also operable to rotatably adjust the pinion housing, the O.D. of which is eccentric relative to its I.D. Thus rotation of the bearing housing within the bore effects the adjustment of the vertical height of the pinion relative to the driving gear.

2 Claims, 3 Drawing Figures

GEAR AND PINION BACKLASH ADJUSTMENT FOR THE DRIVE OF A GYRATORY CRUSHER

BACKGROUND OF THE INVENTION

In a gyratory crusher of the type depicted, intermesh relationship between the drive pinion and the driven gear can vary considerably due to machining tolerance of the machined parts and clearances in the outer bearing and also due to the tolerance of the gears. In order to maintain correct running clearances between the drive pinion and the driven gear, it is necessary to adjust the backlash between the gears to a predetermined desired setting. In prior art crushers, the backlash adjustment is made by means of steel shims to change the relative position of the drive pinion and the driven gear. In using shims for effecting such adjustment it is necessary to disassemble and reassemble several parts of the machine. This is a time consuming and relatively costly method of effecting the adjustment.

SUMMARY OF THE INVENTION

As herein disclosed, there is provided an improved means for effecting backlash adjustment which can be accomplished from the exterior of the crusher and without the necessity of disassembling any of the machine components. The time involved in such adjustment is minimal allowing for more frequent adjusting of backlash without taking the crusher out of service for prolonged periods.

The arrangement discloses a bevel gear secured as an input drive to a cam eccentric which rotates about a fixed vertical axis. A bevel pinion is arranged to drive the bevel gear and is arranged in a manner that its axis of rotation intersects the vertical axis about which the bevel gear rotates. The shaft on which the bevel pinion gear is supported is supported in a pair of spaced apart antifriction bearings that are carried in a bearing support. The bearing support in turn is carried in a bore of a laterally extending housing and is arranged therein so that its longitudinal axis and, therefore, the longitudinal axis of the pinion gear shaft, is offset with respect to the longitudinal axis of the bore of the housing. By effecting a rotational adjustment of the bearing carrier in a manner to rotate its axis around the axis of the housing bore an adjustment of the bevel pinion gear with respect to the bevel gear of the eccentric will be effected to obtain a desired amount of backlash between the bevel pinion gear and the bevel gear of the eccentric. The adjustment is made external of the crusher with a minimum of time and thus can be accomplished more frequently as compared to the shim method of adjusting backlash. As a result, the gears are relatively quiet and the life of the gears is extended.

DESCRIPTION OF THE INVENTION

Figure 1:
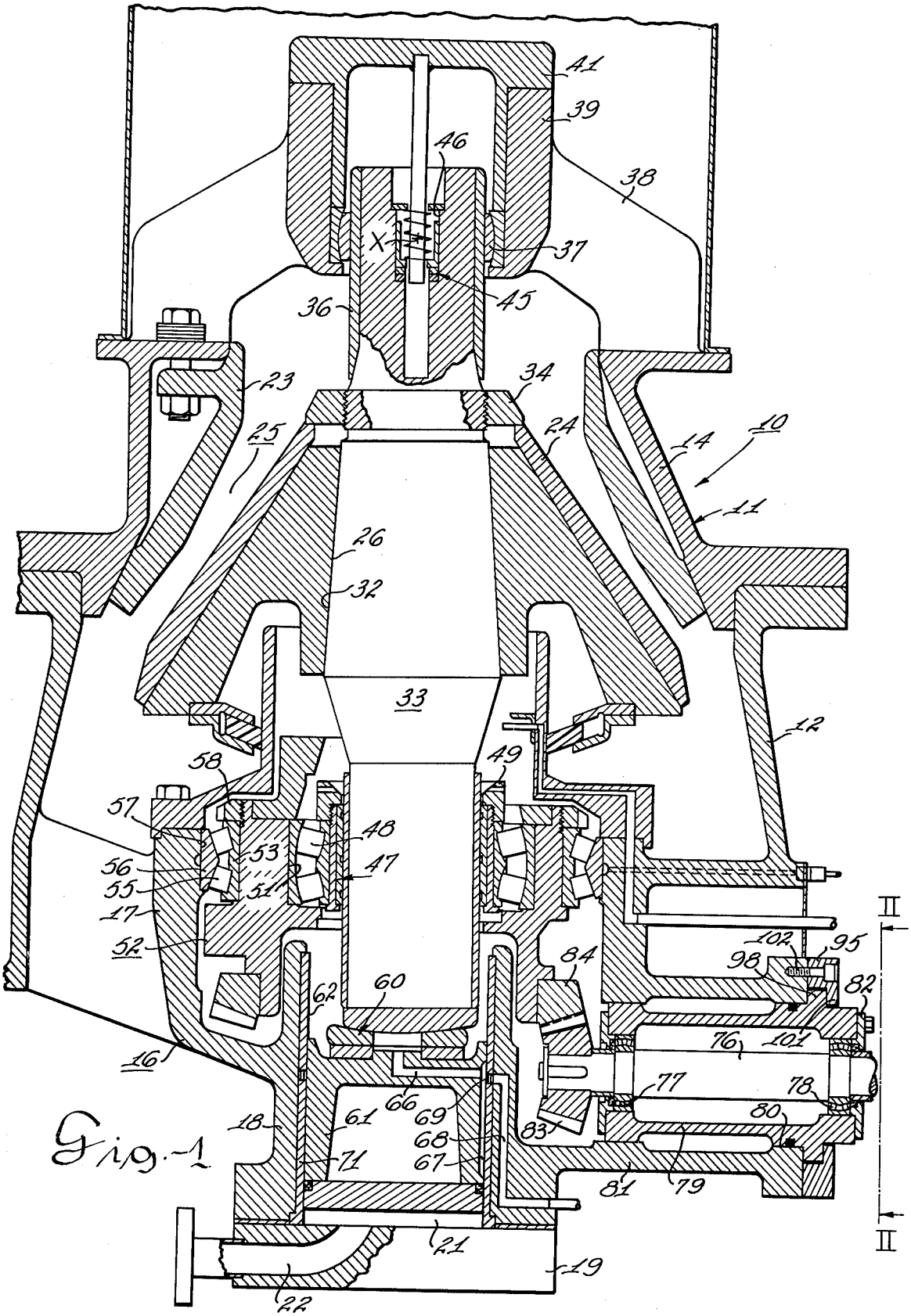
FIG. 1 is a view in vertical section of a gyratory crusher embodying the present invention.

Referring to FIG. 1 of the drawing, there is shown a gyratory crusher 10 having a frame generally indicated at 11 and including a lower frame section 12 and an upper frame section 14. The lower frame section 12 includes a fixed vertical hub 16 having an upper portion 17 and a lower portion 18. The lower hub portion 18 is provided with a closure plate 19 which forms sealed chamber 21. The closure plate 19 also provides for a hydraulic fluid inlet 22 which communicates with the expansible chamber 21.

The upper frame section 14 opens upwardly and has secured therein a concave ring 23 which is supported in coaxial relationship above the hub 16. A generally conical crushing head 24 projects upwardly within the concave ring 23 to define therebetween a crushing chamber 25. The crushing head 24 is supported and arranged with its central axis inclined relative to and intersecting with the vertical axis of the hub 16 and concave ring 23. The axes intersect at a point X above the crushing head 24. The crushing head 24 has a central upwardly tapering bore 26 which is adapted to receive a tapered or frusto-conical portion 32 of a crusher post 33.

A nut 34 is threadedly engaged on the crusher post 33 at a position adjacent the upper end of the crusher head 24 and serves to lock the crusher head in operative position on the post 33. The upper portion of the crusher post 33 is fitted with a bearing sleeve 36 and received in a pivot bearing member 37. A spider 38 being an integral part of the top of the frame 11 presents an axial hub 39, the axis of which coincides with the axis of the frame. The hub 39 serves as a housing for the pivot bearing 37. A cap 41 is secured to the outer end face of the hub 39 and locks the outer race of the pivot bearing 37 in the hub. A crusher head brake device 45 is accommodated in a suitable stepped bore 46 formed in the upper end of the crusher head post 33.

The lower end of the crusher head post 33 is provided with a bearing sleeve assembly 47 which is journalled in the inner race of a radial bearing 48. A nut 49 threadedly engaged on the outer member of the bearing assembly 47 is formed with an axially extending sleeve portion which abuts the inner race of the radial bearing 48 to lock it in position. The outer race of radial bearing 48 is supported in a bore 51 of a drive eccentric 52. A bearing surface formed on the exterior of the drive eccentric 52 receives the inner race 53 of a radial bearing 55. The outer race 56 of the bearing 55 is disposed in a circular seat 57 formed on the upper portion 17 of the vertical hub 16. To maintain the bearing 55 stationary within the circular seat 57, the outer race 56 of the bearing has an interference fit with the circular wall of the bearing seat 57. A nut 58 is threadedly engaged on a circular extension of the drive eccentric 52 and is disposed to abut the inner race 53 of the bearing 55.

An axial thrust bearing 60 is disposed beneath the crusher head shaft 33 between the lower axial end face thereof and a piston 61 within a cylinder 62 defined by the closure plate 19. Lubrication of the thrust bearing 60 is accomplished through a communicating oil passage 66 formed in the head of the piston 61. The passage 66 communicates with a vertical oil groove 67 in the exterior surface of the piston. Lubricating oil from a source (not shown) is supplied to the vertical groove 67 via a passage 68 that connects with the vertical groove 67 via a port 69 drilled in the sleeve liner 71 of the cylinder 62.

To drive the crusher, a pinion gear drive shaft 76 is journalled in bearings 77 and 78 carried by a bearing carrier 79 which is disposed within a bore 80 of a laterally extending hub 81 formed with the lower portion 18 of the frame hub section 16. A bearing retainer plate 82 is disposed around the shaft 76 and is screw fastened to the outer axial end face of the bearing retainer 79. The shaft 76 is driven by any suitable source of power. At its inner end, drive shaft 76 carries a pinion drive gear 83 that is in meshing engagement with a gear 84 connected to the drive eccentric 52. Thus, shaft 33 is free to move axially up and down within the bearing sleeve assembly 47 while still maintaining its gyratory drive connection with the drive eccentric 52.

In the operation of the crusher 10, power is applied to drive the pinion 83 and rotate the gear 84. This effects rotation of the drive eccentric 52 which rotates in an orbit about the vertical axis of the crusher. Thus, the axis of the crusher head shaft 33 is driven in gyratory motion and transcribes a cone about the central vertical axis of the crusher. This motion provides the crushing action of head 24 in the crushing chamber 25. As the crusher head shaft 33 is driven in its gyratory motion about the central vertical axis of the crusher, crushing forces which are the result of stone being broken between the head 24 and the concave 23 develop forces which react on the head 24. These forces cause the head 24 and thereby the shaft 33 to rotate about the axis of the crusher head shaft 33 slowly in the opposite direction to the eccentric 52 rotation while the crusher head shaft is being bodily moved in a gyratory path of travel about the central vertical axis of the crusher.

Vertical support and positioning of the crusher head 24 for adjusting the opening of the crushing chamber 25 is accomplished by hydraulic fluid under pressure. For this purpose, hydraulic fluid under pressure is supplied to the expansible chamber 21 via the passage 22 in the closure plate 19. The fluid under pressure in chamber 21 reacts on the piston 61 elevating the shaft 33 and thereby the crusher head 24 (or lowers the assembly) as desired.

Figure 2:
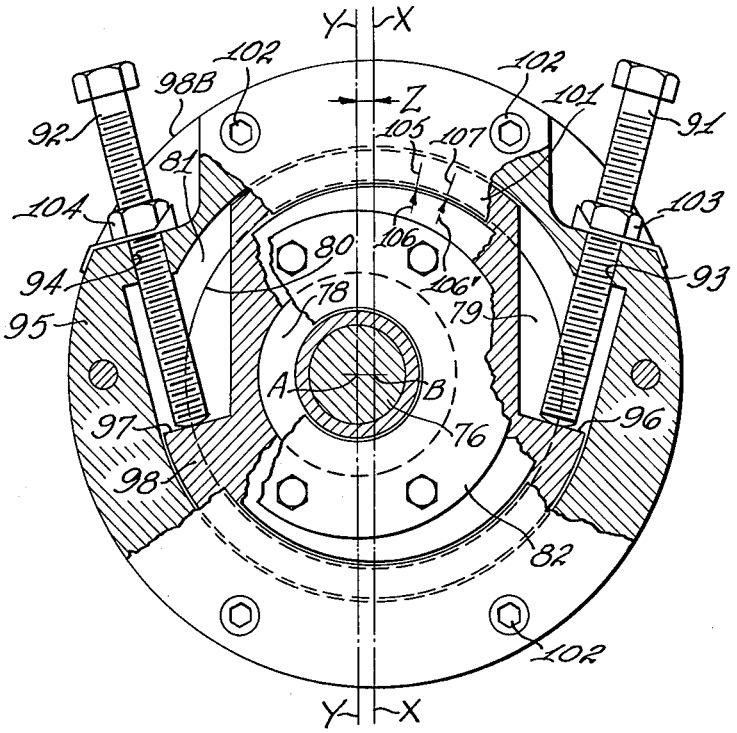
FIG. 2 is a view in elevation taken in a plane represented by the line II—II in FIG. 1, of the backlash adjusting means, with parts broken away to show internal component arrangement; and, FIG. 3 is a modified form of the backlash adjusting means of FIG. 2.

As previously mentioned, an adjustment between the pinion gear 83 and the gear 84 to provide a predetermined amount of backlash between the gears is highly desirable. This is true because if the gears 83 and 84 have an extremely close tooth engagement gear noise increases. It is also true that with bevel gears such as the gears 83 and 84 a tight tooth engagement results in undue wear. Thus, the ability to adjust the intermeshed relationship between the gears to provide a desired amount of backlash therebetween is desirable. To this end, as shown in FIG. 2, the longitudinal axis of the bearing carrier 79 indicated by the letter A which is concentric with longitudinal axis of the pinion gear drive shaft 76 is offset with respect to the axis of the bore 80 indicated by the letter B of the lateral extending hub 81. In FIG. 2, the vertical line X—X passes through the axis B of the bore 80 while the vertical line Y—Y passes through the axis A of the bearing carrier 79 and the space Z between the lines X—X and Y—Y clearly indicates the offset relationship of the two axes.

Rotation of the bearing carrier 79 in a clockwise direction as viewed in FIG. 2 will effect the bodily movement of the pinion gear 83 upwardly with respect to the beveled gear 84. Conversely, rotation of the bearing carrier 79 in a counterclockwise direction, as viewed in FIG. 2, will effect bodily movement of the pinion gear 83 away from the bevel gear 84. Such adjustment of the bearing carrier 79 is effected by means of jackscrews 91 and 92. As shown, the jackscrews 91 and 92 are each threadedly engaged in suitable bores 93 and 94, respectively, formed in a clamp ring 95. The inner ends of the jackscrew abut bearing surfaces 96 and 97 formed in a radial flange portion 98 of the bearing carrier 79. The clamp ring 95 operates to clamp the bearing carrier 79 in an adjusted position. To this purpose the clamp ring 95 is provided with a radially inwardly extending flange 101 which engages the face of the radial extending flange portion 98 of the bearing carrier 79. A plurality of screws 102 extend through the clamp ring 95 into threaded engagement in the hub 81.

By loosening the screws 102 the clamp ring 95 is released and the position of the bearing carrier 78 with the bore 80 and thus the pinion gear 83 can be adjusted to establish the desired amount of backlash between the gears 83 and 84. By backing off the jackscrew 92 and tightening the jackscrew 91 the bearing retainer 79 and thus pinion gear 83 will rotate about the axis B of the bore 80. In so doing the pinion gear 83 as viewed in FIG. 1, will be adjusted upwardly in a vertical plane into closer meshing engagement with the bevel gear 84. It is true that in effecting the vertical height adjustment of the pinion gear 83 some amount of lateral displacement will occur. However, the amount of lateral displacement will be small in comparison with the vertical movement. For example, in the case of a 0.5 inch offset pinion center, that is, the distance *z*, the vertical adjustment can be $\pm 0.086$ inch compared to a total lateral displacement of 0.0075 inch when the pinion housing is adjusted through 10° in either direction. After the desired adjustment of the pinion gear 83 with respect to the bevel gear 84 has been established the jackscrews 91 and 92 are firmed against the surfaces 96 and 97, respectively, and are locked in place with lock nuts 103 and 104. Thereafter the screws 102 are tightened to reclamp the bearing carrier 79 in the adjusted position.

In adjusting the pinion the bearing carrier 79 is rotated in a clockwise direction, as viewed in FIG. 2, until initial resistance between the teeth of the gears 83 and 84 is sensed. This radial position of bearing carrier 79 is marked, that is, a mark 105 is marked on the clamp ring 95 opposite the mark 106 on the bearing carrier. Thereafter the bearing carrier 79 is rotated further in a clockwise direction around the axis B of the bore 80, by operation of the jackscrew 91 until all longitudinal clearance has been removed from bearing 55. At this point the bearing carrier mark 106 will be in a position assumed to be as indicated by the broken line showing of the mark and indicated as 106' and a mark 107 will be made on the clamp ring 95. The bearing carrier 95 will then be rotated in a counterclockwise direction by backing off the jackscrew 91 and taking up on the jackscrew until the bearing carrier mark 106 is positioned halfway between the marks 105 and 107. This halfway position is an ideal driving relationship position without backlash which will not obtain under operating conditions and further adjustment is necessary. From known tables, the running clearance expressed as backlash for gears similar to gears 83 and 84 can be determined. With this figure at hand the bearing carrier is located about the axis B until the proper backlash between the gears is established.

Figure 3:
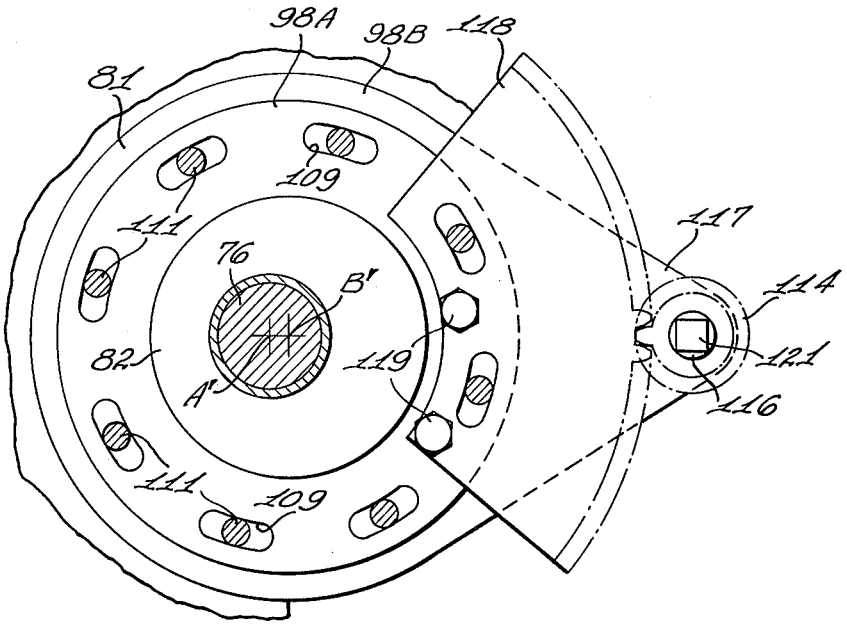

In FIGS. 1 and 3, in the bearing carrier an adjustment member is shown. As depicted, the bearing carrier 79 is provided with an outwardly extending flange 98A in which is formed a plurality of arcuate slots 109. Each slot 109 receives a screw 111 which extends through the associated slot into threaded engagement with the axial end face of the laterally extending hub 81. By tightening the screws 111 the angular position of the bearing carrier is fixed within the bore 80. To adjust the angular position of the bearing carrier within the bore 80 there is provided a drive gear 114 which is secured on a suitable shaft 116 that is journalled in an arm 117. The arm 117 is integrally formed as an extension of the radial flange 98B. The drive gear 114 is adapted to mesh with gear teeth formed on the peripheral edge of a sector plate 118. Screws 119 secure the sector plate 118 to the flange 98A. Rotation of the drive gear 114 can be effected by means of a wrench (not shown) which is engageable on a squared end 121 of the shaft 116.

The embodiments of the invention in which an exclusive property or privilege is claimed are defined as follows:

1. In a gyratory crusher having a frame, a crusher head supported for movement on a shaft and a drive connected to rotate the shaft:

a bevel gear connected to effect rotation of the shaft;

a horizontal bore in the crusher frame communicating from the exterior into the interior thereof;

a pinion drive shaft having a horizontal axis supported in said bore for rotation about its own axis and for bodily rotation about the axis of said bore;

a pinion gear mounted on said pinion drive shaft for rotation with said pinion drive shaft and for bodily movement with said pinion drive shaft about the axis of the bore, said pinion gear being meshed with said bevel gear and disposed with its axis transverse to the axis of the bevel gear and in a vertical plane that passes through the axes of both of said gears;

a pair of bearings in which said pinion drive shaft is rotatably supported;

a bearing carrier for supporting said bearings in said bore, the axis of said bearing carrier and said bearings and said pinion drive shaft being concentric;

said bearing carrier being provided with a radially outwardly extending flange that abuts the surface of the frame around said bore;

a clamp ring secured to the frame in position to engage and clamp said radial flange of said bearing carrier to the frame;

a pair of jackscrews threadedly engaged in said clamp ring and extending therethrough and into engagement with said bearing carrier on opposite sides thereof, said jackscrews when actuated operating to effect rotation of said bearing carrier about the axis of said bore in a selected direction to thereby move said pinion gear vertically with respect to said bevel gear for establishing a predetermined amount of backlash between said gears, said jackscrews acting together being further operable to lock said bearing carrier in an adjusted position.

2. A gyratory crusher according to claim 1 wherein said clamp ring is formed with a pair of surfaces, one on each side of a vertical plane which passes through its axis, and above a horizontal plane which passes through its axis, the threaded bores in which said jackscrews are engaged being formed with their axes perpendicular to the surface of an associated clamp ring surface, the inner ends of jackscrews abutting an associated surface formed in the radial flange of said bearing carrier; and, lock nuts threadedly engaged on each of said jackscrews and operable to engage the surface on said clamp ring to lock said jackscrews in adjusted position.

* * * * *